US006159093A

United States Patent [19]

Mihalko, III

[11] Patent Number: 6,159,093

[45] Date of Patent: Dec. 12, 2000

[54] POWERED EXHAUST FAN

[76] Inventor: Louis Mihalko, III, 439 50 Acres Rd., Johnstown, Pa. 15904

[21] Appl. No.: 09/273,572

[22] Filed: Mar. 22, 1999

[51] Int. Cl.[7] ..... F24F 7/007

[52] U.S. Cl. ..... 454/341; 454/354; 454/365

[58] Field of Search ..... 454/365, 341, 454/354

[56] References Cited

U.S. PATENT DOCUMENTS

| | | | |
|---|---|---|---|
| 2,665,626 | 1/1954 | Jones | 454/349 |
| 2,889,763 | 6/1959 | Pine . | |
| 2,897,742 | 8/1959 | Ryburn et al. . | |
| 3,085,490 | 4/1963 | Field . | |
| 3,625,134 | 12/1971 | Smith . | |
| 4,201,121 | 5/1980 | Brandenburg, Jr. | 454/365 |

*Primary Examiner*—Denise L. Ferensic
*Assistant Examiner*—Jiping Lu
*Attorney, Agent, or Firm*—Banner & Witcoff, Ltd.

[57] ABSTRACT

A powered exhaust fan for ventilating structures, especially well suited for roof ventilation, provides a motor driven fan assembly supported by a support assembly beneath an opening in a roof structure. The fan assembly further includes an air deflector assembly housing an impeller driven by the motor. The air deflector assembly also includes an intake portion and an exhaust portion. The fan assembly is positioned so that rising warm air is drawn into the intake portion by the rotating impeller and is directed into the inner surface of the air deflector assembly, out of the exhaust portion and then out through the roof opening. The positioning of the exhaust fan below the roof minimizes the negative aesthetic impact of the exhaust fan and allows it to be installed with existing passive ventilation systems.

29 Claims, 3 Drawing Sheets

POWERED EXHAUST FAN

BACKGROUND OF THE INVENTION

The present invention relates to a powered exhaust fan and in particular to an internally mounted powered exhaust fan for building structures.

Originally, before the introduction of insulation, ventilation occurred by air flowing freely through the ceilings of building structures into attic airspaces. During warmer seasons, it was advantageous to allow this air to passively ventilate through roof vents, to cool the structure. During cooler seasons the passive vents were closed off to trap the heat within the home.

A well known form of passive ventilation is a system of ridge and soffit vents. Ridge vents include a slot along a ridge or roof peak, typically where the warmest air collects. This slot is covered with another peaked structure which blocks out the elements and reduces airflow into the structure through the ridge vent. Soffit vents appear on the underside of the overhanging portion of the roof structure. Air flow occurs when the positive pressure of the ridge vent pulls air upwards through the soffit vents.

Passive ventilation was sufficient for most structures until recent advances in building technology and insulation methods led to the construction of more airtight buildings. In a newer building heavy insulation is typically used in the ceiling obviating the need for warm air in the attic to keep the structure warm. In fact, trapped warm air has become a liability. With the concurrent addition of more water sources in newer structures, such as bathrooms, shower, humidifiers etc., the trapped air has a tendency to become very humid. This increased humidity causes dampness in the structural elements of the building resulting in damage to the structural elements after successive freeze-thaw cycles.

Another advance concurrent to improved building insulation has been the advent of common air conditioning. Air conditioning cools outside, or ambient air, for building structure use. Even with the cooling effect of passive ventilation the ventilated air is still warmer than the mechanically cooled air within the building. This creates a "hot-plate" effect where the warm ceiling of the structure radiates heat into the structure, partially undoing the cooling effect of the air conditioner.

These problems have led to a need for improvements over traditional passive ventilation. The prior art has attempted to address these problems through the addition of powered fans to the ventilation systems. U.S. Pat. No. 3,085,490 to Field discloses a box structure containing a powered fan and a vent. The box structure physically sits on top of the roof over a rectangular hole cut into the rooftop. The powered fan draws air through the hole in the roof top and forces this air through the vent in the box structure. This invention is an improvement over a passive vent of the same size but still has several drawbacks. One drawback is that the Field ventilation system is aesthetically unacceptable for many applications. The box structure of the field ventilation system sits on top of the roof and is not similar to the roof in shape or in the material used for its construction. Another drawback is that the Field ventilation system creates a stronger flow of air with its powered fan but only in a narrow stream, leaving significant unmoving or "dead" air within the attic. Any potential remedy would be at an increased expense and would have a greater adverse impact on the appearance of the structure.

SUMMARY OF THE INVENTION

In view of the foregoing, it is a principal object of the present invention to provide an exhaust fan system that creates strong airflow over a wide area.

It is a further object of the invention to provide a powered exhaust fan system that combines the above object with a low profile and aesthetically pleasing appearance.

These and other objects are achieved in accordance with the present invention by a powered exhaust fan system for ventilating a structure. The powered exhaust fan system includes a roof, a support assembly, a motor and a fan assembly. The roof has a roof opening and the support assembly is fixedly positioned below the roof and the roof opening. The motor is attached to the support assembly and includes a driveshaft. The fan assembly is also attached to the support assembly and also includes an impeller and an air deflector assembly. The impeller is operatively coupled to the motor driveshaft and positioned within the air deflector assembly. The air deflector assembly includes an intake portion and an exhaust portion. The air deflector assembly is positioned relative to the roof such that air is drawn into the impeller through the intake portion, is exhausted from the impeller and passes through the exhaust portion and then through the roof opening.

In another aspect, the invention is embodied in an exhaust fan system including a support assembly, a motor and a fan assembly. The support assembly allows attachment of the motor and fan assembly under a roof and near a roof opening. The motor is attached to the support assembly and includes a driveshaft. The fan assembly is also attached to the support assembly and includes an impeller and an air deflector assembly. The impeller is operatively coupled to the motor driveshaft and positioned within the air deflector assembly. The air deflector assembly includes an intake portion and an exhaust portion. The air deflector assembly is positioned relative to the roof such that air is drawn into the impeller through the intake portion, is exhausted from the impeller and passes through the exhaust portion and then through the roof opening.

In still another aspect, the invention is embodied in an exhaust fan system including a support assembly, a motor and a fan assembly. The motor is attached to the support assembly and includes a driveshaft. The fan assembly is also attached to the support assembly and includes an impeller and an air deflector assembly. The air deflector assembly has a channel with a first intake end, a second intake end, a longitudinal exhaust slot and an inside surface. The first and second intake ends form an intake portion and the longitudinal exhaust slot forms an exhaust portion. An impeller is positioned within the air deflector assembly and operatively coupled to the motor driveshaft. The impeller is spaced from the inside surface wherein rotation of the impellers by the motor draws air through the first and second intake ends of the air deflector. The impeller blades force the airflow radially into the inside surface of the air deflector assembly which directs the airflow out through the longitudinal exhaust slot.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
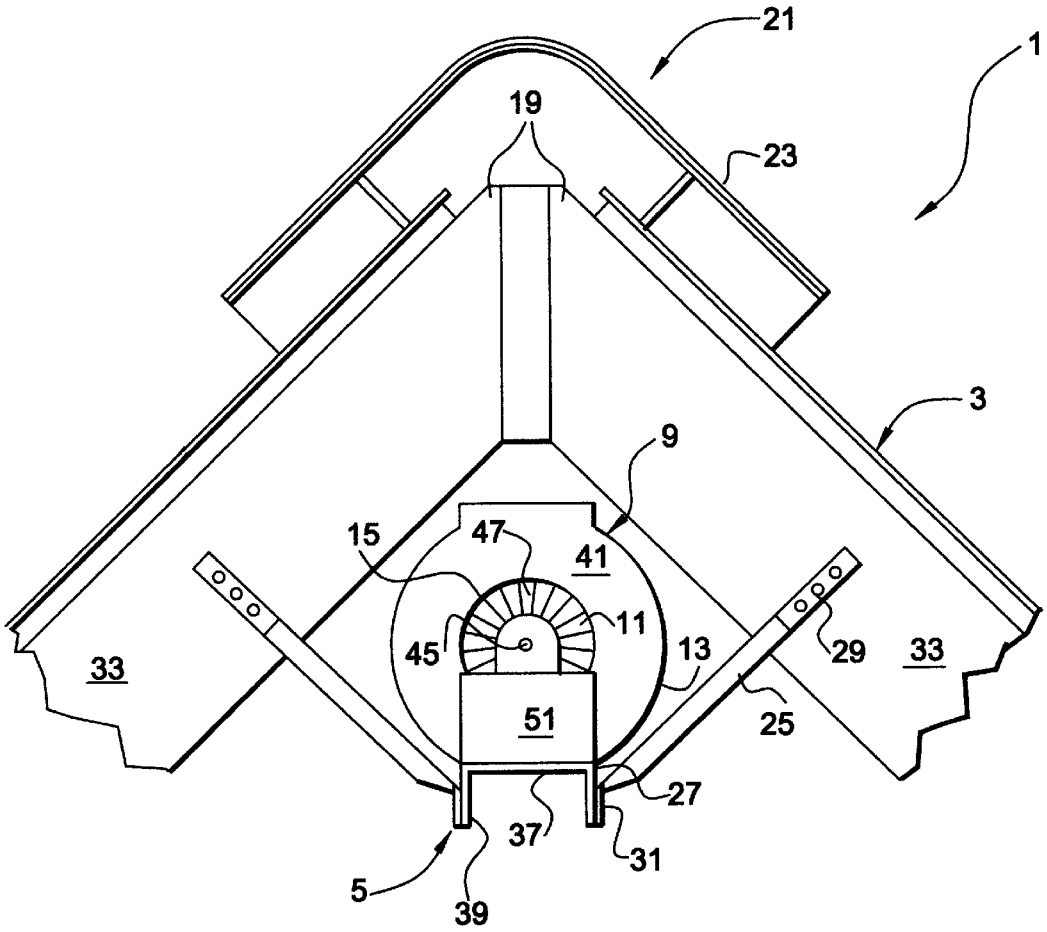
FIG. 1 is an end elevated view of a powered exhaust fan system installed in a roof structure.
Figure 2:
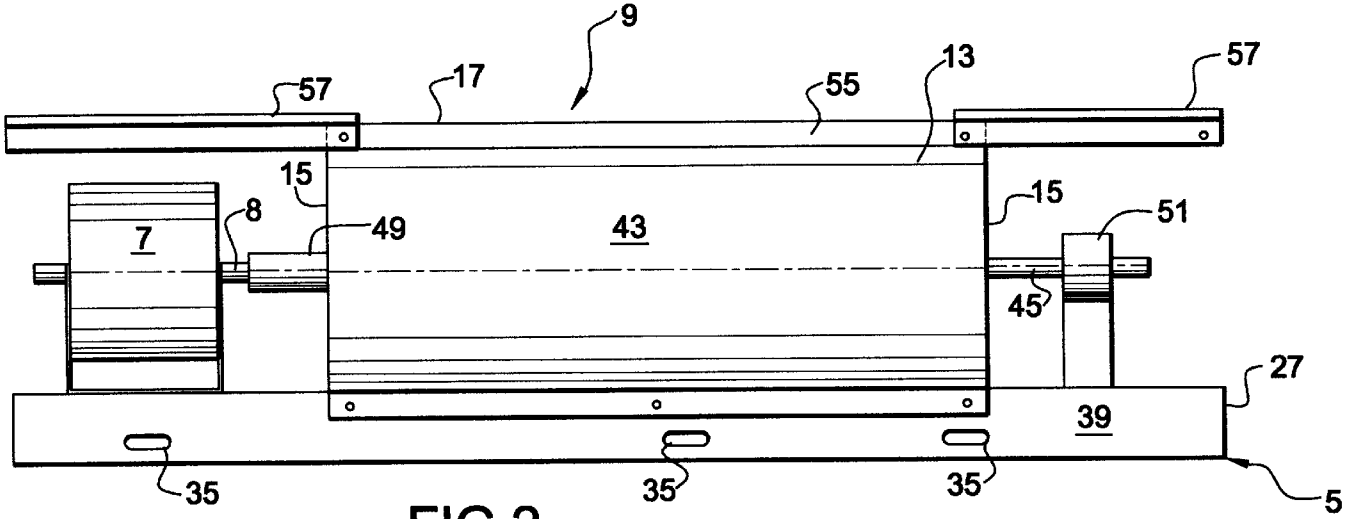
FIG. 2 is a side elevated view of the support assembly supporting the fan assembly and motor that drives the exhaust fan system shown in FIG. 1.
Figure 3:
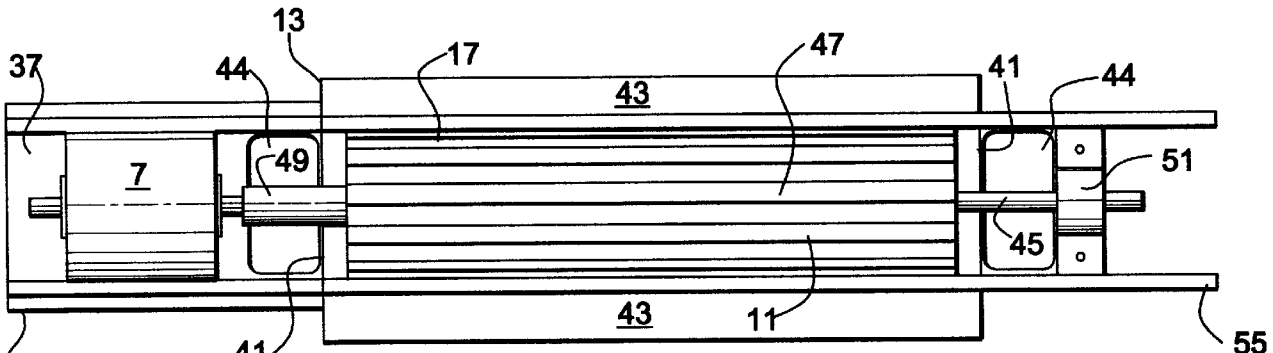
FIG. 3 is a top view of the support assembly with the cover plates removed, fan assembly and motor of the exhaust fan system shown in FIG. 2 revealing the impeller of the fan assembly.

Referring initially to FIGS. 1–3, a powered exhaust fan system 1 for ventilation positioned within a roof structure 3. Fan system 1 is supported below roof structure 3 having a roof opening 19. Support assembly 5 supports a motor 7 with a motor driveshaft 8, and a fan assembly 9. Fan assembly 9 includes an impeller 11 positioned within an air deflector assembly 13, and operatively coupled to motor 7. Rotation of impeller 11 draws air through an intake portions 15 of air deflector assembly 13 and out through an exhaust portion 17 of the air deflector assembly 13. The intake portions 15 are circular cut-outs positioned at the lateral ends of air deflector assembly 13, adjacent to the lateral ends of impeller 11 and near a peak of roof structure 3. Exhaust portion 17 has the shape of a slot, is positioned at the top of air deflector assembly 13, at a tangent to the radial edge of impeller 11 and adjacent to roof opening 19. This positioning relative to roof structure 3 causes the rising warm air to be drawn through intake portions 15, into the impeller 11. The impeller 11 forces the air into air deflector assembly 13 which directs the air out of the exhaust portion 17 and through roof opening 19.

Roof opening 19 is part of a ridge vent 21 constructed similar to existing ridge vents known and used in the art for passive ventilation. Ridge vent 21 may also be an already existing ridge vent wherein the remaining parts of powered exhaust fan system 1 can be retrofit to the ridge vent 21. To construct roof opening 19, an elongated slot is cut in roof structure 3 where it joins at an angle to form a peak. A vent cover 23 is constructed of building materials similar to roof structure 3. Vent cover 23 spans the length of roof opening 19, is congruent in shape to roof structure 3, and is secured to roof structure 3 by wooden struts or other common fixation means that allow clearance between roof structure 3 and vent cover 23. The clearance allows airflow out roof opening 19, under vent cover 23 and into the environment. Vent cover 23 serves a dual purpose of keeping precipitation from entering through roof opening 19 and directing airflow over roof structure 3 instead of into roof opening 19. Since vent cover 23 has a low profile and is preferably similar in construction material and shape to the roof, it is aesthetically acceptable for use in all applications. Other shapes and materials may be used to construct vent cover 23. Ridge vent 21 may be varied in size and length to suit the size of roof structure 3 and the amount of ventilation desired.

The relative position between fan assembly 9, motor 7 and roof structure 3 is maintained by support assembly 5. Support assembly 5 includes plurality of brackets 25 longitudinally spaced along the length of a base 27. Base 27 is preferably in the shape of a channel that extends the length of roof opening 19 with a horizontal floor 37 and vertical sidewalls 39. Brackets 25 each have a roof end 29 at their top and a base end 31 at their bottom. Roof end 29 is bolted to a joist 33 on the underside of roof structure 3. Base end 31 is bolted to base sidewalls 39 through a series of elongated slots 35 in sidewalls 39. Slots 35 are preferably positioned along base 27 to correspond to the number and spacing of joists 33. The shape of slots 35 allow some adjustability to compensate for normal installation error, irregular joist positioning, etc. Other conventional methods of fixation may also be used such as nails, screws, clamps and the like to fix brackets 25 to base 27 and joist 33.

As shown best in FIG. 1, support assembly 5, when installed, positions exhaust portion 17 of the air deflector assembly 13 directly below roof opening 19 and positions intakes 15 at the ridge of roof structure 3 where the warmest air collects. Another advantage is that the entire powered exhaust fan system 1 is positioned under roof structure 3 so as not to disrupt the aesthetic appeal of the roof. A multitude of variations may be used in construction of support assembly 5 to achieve the same positioning of fan assembly 9. For example, support assembly 5 may be constructed of a single sheet of material spanning joists 33 or a single vertical post at either end of base member 27 and attached near the peak of roof structure 3.

Fan assembly 9 and motor 7 are secured by bolts, other hardware, or other conventional attachment devices, to floor 37 of base 27. Fan assembly 9 includes an air deflector assembly 13 and an impeller 11. Air deflector assembly 13 includes a pair of deflector end walls 41 and a pair of deflector sidewalls 43 as is best shown in FIG. 3. The deflector sidewalls 43 are attached at their bottoms to sidewalls 39 on opposite sides of base 27. The cross-section of deflector sidewalls 43 are partial arcs extending upwards in the direction of airflow and terminating in a straight, vertical portion which defines exhaust portion 17. Air deflector assembly 13 further includes a pair of intakes 15 in the form of circular cut-outs in deflector end walls 41 that are centered about the axis of rotation of impeller 11. Other shapes could be used, but a circular shape is desirable because it allows evenly distributed airflow into the blades of impeller 11.

Deflector end walls 41 of air deflector assembly 13 restrain air forced radially by the spinning of impeller 11. The amount of air loss restrained by end walls 41 and the amount of intake air varies with the diameter of circular intakes 15 and can be adjusted for each desired use relying on a range of factors such as impeller speed and air temperature. Base 27 includes a plurality of rectangular inlet ports 44 longitudinally spaced along its length and positioned to appear below intakes 15. Inlet ports 44 allow additional airflow through base member 27. Inlet ports 44 may be varied in size and shape depending upon the desired airflow and size of base 27. The close proximity of inlet ports 44 to intakes 15 increases the flow of air from below the fan system; through inlet ports 44 into intakes 15.

Impeller 11 includes a set of blades 47 radiating from an impeller shaft 45. Motor 7 and fan assembly 9 are positioned relative to each other such that impeller shaft 45 and motor driveshaft 8 are approximately collinear. Impeller shaft 45 is operatively coupled to motor 7 through a coupling 49 capable of withstanding the fatigue and impact loads transmitted through motor driveshaft 8. Coupling 49 is constructed of flexible material, such as rubber, to allow additional tolerance in the positioning of motor 7 and fan assembly 9. Motor 7 has an operation speed and torque custom configured for the amounts of airflow needed. In cases where the rotation speed of motor 7 differs from the desired speed of impellers 11 a speed reducer may be substituted for the illustrated direct drive of coupling 49. Also, if a range of rotation speeds are desired for impeller 11 a variable speed transmission may be used. However, the direct drive method using coupling 49 has the advantage of reliability and low cost because it minimizes the number of moving components and simplifies the control structure. A pillow block bearing 51 is fixed to base member 29 on the opposite side of fan assembly 9 from motor 7. Pillow block bearing 51 provides additional support for impeller shaft 45 and also reduces loads on coupling 49 and motor driveshaft 8.

Air deflector sidewalls 43 in conjunction with base floor 37 have an approximately circular cross-section with an open arc portion removed for exhaust 13. The dimensions and shapes of the cross-section of air deflector assembly 13 may be varied significantly, having such shapes as a square, triangle, ellipse or some other more irregular shape. The circular cross-section, however, conforms closely to the shape of the rotating impeller 11, thereby tightly confining airflow off of impeller blades 47 and directing the airflow to exhaust 17.

Figure 4:
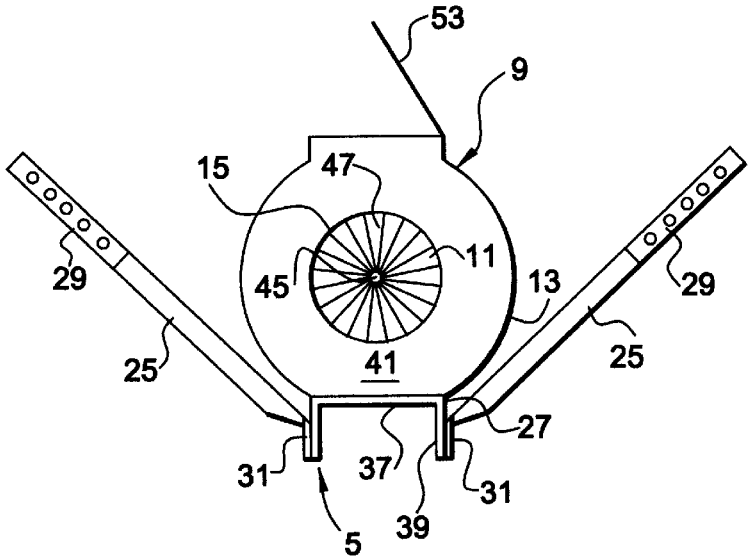
FIG. 4 is a front elevated view of the fan assembly shown in FIG. 1 with the addition of a secondary deflector plate for further directing exhaust air of the powered exhaust fan system.

The top edge of deflector sidewalls 43 and deflector end walls 41 define exhaust 17. Deflector sidewalls 43 are considerably longer than deflector end walls 41 rendering exhaust 17 an elongated slot. This slot shape approximately matches the dimensions of roof opening 19 in ridge vent 21. The distance between roof opening and exhaust 17 may be bridged by the addition of a secondary deflector plate 53 shown in FIG. 4. Secondary deflector plate 53 is a plate the length of the deflector assembly attached along its base to the top edge of a deflector sidewall 43. The secondary deflector plate 53 also serves to narrow the slot shape of exhaust 17 even further for closer conformity to roof opening 19.

In a complete description of its path, warm air below roof structure 3 travels upwards and is drawn up and around base 27 or through rectangular inlet ports 44 in base 27. Rotation of impeller 11 by motor 7 creates a negative pressure at circular intakes 15 drawing the warm air into spinning impeller blades 47 near impeller shaft 45. Spinning impeller blades 47 drive the air radially into the inner surface of deflector sidewalls 43 and off of floor 37 of base 27. The air is guided by deflector sidewalls 43 and deflector end walls 41 upwards to exhaust 17. Because of the elongated slot shape of exhaust 17 and the further narrowing by deflector plate 53, the air exits fan assembly 9 in a long stream matching the dimensions of roof opening 19. This long stream of exhaust air travels through opening 19 and is redirected downwards and along the outer surface of roof structure 3 by the inner surface of vent cover 23.

Figure 5:
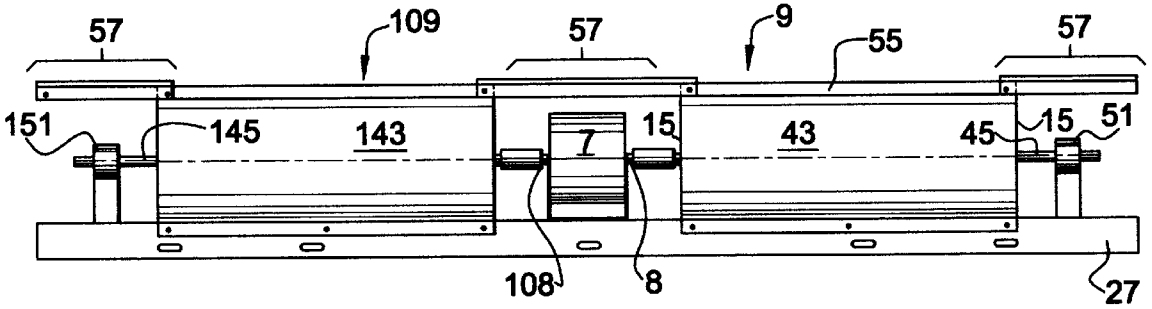
FIG. 5 is a side elevated view of a powered exhaust fan system with a motor in between and providing power to two of the fan assemblies shown in FIG. 2.
Figure 6:
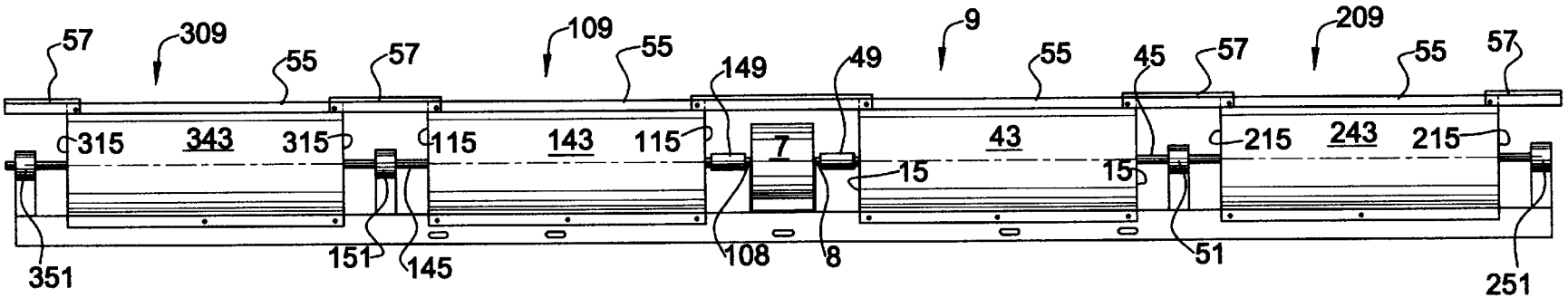
FIG. 6 is a side elevated view of a powered exhaust fan system with a motor between and providing power to two pairs of the fan assemblies shown in FIG. 2.

A second embodiment, shown in FIG. 5 has a second fan assembly 109 operably connected by a second coupling 149 to a second motor driveshaft 108. In this arrangement motor 7 is between fan assembly 9 and fan assembly 109. In a third embodiment shown in FIG. 6, third and fourth fan assemblies 209 and 309 are included with third fan assembly 209 operably connected to impeller shaft 45 of first fan assembly 9 and fourth fan assembly 309 operably connected to impeller shaft 145 of second fan assembly 109. This arrangement may be expanded as desired but limited to the drive capabilities of motor 7. Additional motors could also be included in series or interdigitated between fan assemblies. Support for each respective impeller shaft of each assembly is provided by additional pillow block bearings 151, 251 and 351. Further support for the additional air deflector assemblies is supplied by a set of top rails 55 affixed to the top edge of deflector sidewalls 43, 143, 243 and 343. Top rails 55 may also include a plurality of cover plates 57. Cover plates 57, as shown in FIG. 5, are the width of top rails 55 and longitudinally extend between exhaust portions 17. Cover plates 57 cover motor 7, pillow block bearings 51 and 151 and all areas between top rails 55 except for exhaust portions 17. Cover plates 57 keep outside air from being drawn through roof opening 19 and into intake portions 15. This maximizes air flow from below roof structure 3 and into intake portions 15.

There are several advantages to the multiple fan assemblies of the above embodiments for buildings with a longer ridge vent 21. A single long fan assembly would require a much larger impeller shaft 45 without the additional support of pillow block bearings 151, 251 and 351. Also, the interspersing of the respective intakes 15, 115, 215 and 315 along the length of ridge vent 21 permit a more uniform flow out of the structure, thus cutting down on the occurrence of "dead" air.

The impeller used in the above preferred embodiments is from a fan known in the art as a tangential fan. The tangential style fans have the advantage of allowing a slot-shaped exhaust that is congruent with the roof opening of a ridge vent to maximize the flow of exhaust air. However, it is recognized that many other types of fans may be used and positioned and with their air deflectors accordingly so that air below the roof will pass through the air deflector before passing through the roof opening such as propeller fans, tube-axial fans and vane-axial fans as well as other radial-flow impellers like the tangential fan. The impeller may also be controlled by a range of common control systems including a manual switch or automatically using a thermostat or humidistat.

The present invention has been described in terms of preferred and exemplary embodiments thereof. Numerous other embodiments, modifications and variations within the scope and spirit of the appended claims will occur to persons of ordinary skill in the art.

What is claimed is:

1. A powered exhaust fan system, comprising:

a roof having a roof opening;

a support assembly fixedly positioned below the roof;

a motor having a driveshaft, the motor attached to the support assembly;

a fan assembly attached to the support assembly, the fan assembly including a radial flow impeller and an air deflector assembly, the impeller operatively coupled to the motor driveshaft and positioned within the air deflector assembly, the air deflector assembly including first and second opposed intake ends and a longitudinal exhaust slot, the air deflector assembly positioned relative to the roof such that air is drawn into the impeller through the intake ends, is exhausted from the impeller and passes through the exhaust slot and then through the roof opening.

2. A powered exhaust fan system according to claim 1, wherein rotation of the impeller by the motor draws air through the first and second intake ends of the air deflector, directs the airflow radially into the inside surface and the inside surface directs the airflow out through the longitudinal exhaust slot.

3. A powered exhaust fan system according to claim 1, wherein the fan assembly is a first fan assembly, said system further comprising a second fan assembly including a radial flow impeller and an air deflector assembly having first and second opposed intake ends and a longitudinal exhaust slot, said first fan assembly positioned between the motor and the second fan assembly.

4. A powered exhaust fan system according to claim 1, wherein the fan assembly is a first fan assembly, said system further comprising a second fan assembly including a radial flow impeller and an air deflector assembly having first and second opposed intake ends and a longitudinal exhaust slot, and the motor is positioned between the first fan assembly and said second fan assembly.

5. A powered exhaust fan system according to claim 1, further including a plurality of fan assemblies connected to said motor through said motor driveshaft and longitudinally spaced along the support assembly.

6. A powered exhaust fan system according to claim 1, wherein the support assembly further includes a base member for the attachment of the motor and the fan assembly.

7. A powered exhaust fan system for ventilating a structure having a roof and a roof opening, said system comprising:

a support assembly for fixedly positioning below the roof;

a motor having a driveshaft, said motor attached to said support assembly; and a fan assembly attached to said support assembly, said far assembly including a radial flow impeller and an air deflector assembly, said impeller operatively coupled to said motor driveshaft and positioned within said air deflector assembly, said air deflector assembly including first and second opposed intake ends and a longitudinal exhaust slot, the air deflector assembly positioned relative to the roof such that air is drawn into the impeller through the intake ends, is exhausted from the impeller and passes through the exhaust slot and then through the roof opening.

8. A powered exhaust fan system according to claim 7, wherein rotation of said impeller by said motor draws air through said first and second intake ends of said air deflector, directs said airflow radially into said inside surface and said inside surface directs said airflow out through said longitudinal exhaust slot.

9. A powered exhaust fan system according to claim 8, wherein said fan assembly is a first fan assembly, said system further comprising a second fan assembly including a radial flow impeller and an air deflector assembly having first and second opposed intake ends and a longitudinal exhaust slot, said first fan assembly positioned between said motor and the second fan assembly.

10. A powered exhaust fan system according to claim 8, wherein said fan assembly is a first fan assembly, said system further comprising a second fan assembly including a radial flow impeller and an air deflector assembly having first and second opposed intake ends and a longitudinal exhaust slot, and said motor is positioned between said first fan assembly and said second fan assembly.

11. A powered exhaust fan system according to claim 8, further including a plurality of fan assemblies operably connected to said motor through said motor driveshaft and longitudinally spaced along the support assembly.

12. A powered exhaust fan system according to claim 8, wherein said support assembly further includes a base member for said attachment of said motor and said fan assembly.

13. A powered exhaust fan system, comprising:

a support assembly;

a motor having a driveshaft, said motor attached to said support assembly; and a fan assembly attached to said support assembly said fan assembly including, an air deflector assembly including a channel with opposed first and second intake ends, a longitudinal exhaust slot and an inside surface, said first and second intake ends forming an intake portion and said longitudinal exhaust slot forming an exhaust portion, and a radial flow impeller operatively coupled to said motor driveshaft, positioned within said air deflector assembly an d spaced from said inside surface, wherein rotation of said impeller by said motor draws air through said first and second intake ends of said air deflector, directs said airflow radially into said inside surface and said inside surface directs said airflow out through said longitudinal exhaust slot.

14. A powered exhaust fan system according to claim 13, wherein said fan assembly is a first fan assembly, said system further comprising a second fan assembly including a radial flow impeller and an air deflector assembly having first and second opposed intake ends and a longitudinal exhaust slot, said first fan assembly positioned between said motor and the second fan assembly.

15. A powered exhaust fan system according to claim 13, wherein said fan assembly is a first fan assembly, said system further comprising a second fan assembly including, a radial flow impeller and an air deflector assembly having first and second opposed intake ends and a longitudinal exhaust slot, and said motor is positioned between said first fan assembly and said second fan assembly.

16. A powered exhaust fan system according to claim 13, wherein said fan assembly is a first fan assembly, said powered exhaust fan system further including a second, third and fourth fan assembly, each said fan assembly including a radial flow impeller and an air deflector assembly having first and second opposed intake ends and a longitudinal exhaust slot, said second fan assembly positioned adjacent said first fan assembly, said fourth fan assembly positioned adjacent said third fan assembly and said motor positioned between said third fan assembly and said first fan assembly.

17. A powered exhaust fan system according to claim 13, further including a plurality of fan assemblies operably connected to said motor through said motor driveshaft and longitudinally spaced along the support assembly.

18. A powered exhaust fan system according to claim 13, wherein said support assembly further includes a base member for said attachment of said motor and said fan assembly.

19. A powered exhaust fan system, comprising:

a support assembly;

a motor having a driveshaft, said motor attached to said support assembly; and a fan assembly attached to said support assembly said fan assembly including, an air deflector assembly including a channel with a first intake end, a second intake end, a longitudinal exhaust slot and an inside surface, said first and second intake ends forming an intake portion and said longitudinal exhaust slot forming an exhaust portion, and an impeller operatively coupled to said motor driveshaft, positioned within said air deflector assembly and spaced from said inside surface, wherein rotation of said impeller by said motor draws air through said first and second intake ends of said air deflector, directs said airflow radially into said inside surface and said inside surface directs said airflow out through said longitudinal exhaust slot;

wherein said support assembly further includes a base member for said attachment of said motor and said fan assembly; and wherein said base member further includes a plurality of longitudinally spaced inlet ports positioned adjacent to and below said first and second intake ends thereby allowing increased airflow through said base member into said first and second intake ends.

20. A powered exhaust fan system according to claim 19, wherein said support assembly further includes a plurality of bracket members, said plurality of bracket members longitudinally spaced along, and fixed to, said base member.

21. A powered exhaust fan system according to claim 20, wherein said support assembly further includes a plurality of bearings to support said motor driveshaft and said impeller.

22. A powered exhaust fan system according to claim 21, wherein said support assembly further includes a cover plate connected above said motor.

23. A powered exhaust fan system according to claim 22, wherein said motor driveshaft rotates about a motor axis and said fan also rotates about said motor axis.

24. A powered exhaust fan system, comprising:

a roof having a roof opening;

a support assembly fixedly positioned below the roof;

a motor having a driveshaft, the motor attached to the support assembly;

a fan assembly attached to the support assembly, the fan assembly including an impeller and an air deflector assembly, the impeller operatively coupled to the motor driveshaft and positioned within the air deflector assembly, the air deflector assembly including an intake portion and an exhaust portion, the air deflector assembly positioned relative to the roof such that air is drawn into the impeller through the intake portion, is exhausted from the impeller and passes through the exhaust portion and then through the roof opening;

wherein the air deflector assembly includes a channel with a first intake end, a second intake end, a longitudinal exhaust slot and an inside surface, the first and second intake ends forming the intake unit and the longitudinal exhaust slot forming the exhaust portion;

wherein rotation of the impeller by the motor draws air through the first and second intake ends of the air deflector, directs the airflow radially into the inside surface and the inside surface directs the airflow out through the longitudinal exhaust slot;

wherein the support assembly further includes a base member for the attachment of the motor and the fan assembly; and wherein the base member further includes a plurality of longitudinally spaced inlet ports positioned adjacent to and below the first and second intake ends thereby allowing increased airflow through the base member into the first and second intake ends.

25. A powered exhaust fan system according to claim 24, wherein the support assembly further includes a plurality of bracket members comprising a roof end and a base end, the plurality of bracket members longitudinally spaced along, and fixed to, the base member at the base end and fixed to the roof at the roof end.

26. A powered exhaust fan system according to claim 25, wherein the roof opening is positioned at a peak of the roof thereby accessing rising warm air.

27. A powered exhaust fan system according to claim 26, wherein the roof opening is an elongated slot at the peak of the roof, said elongated slot corresponding in length and width to the longitudinal exhaust slot.

28. A powered exhaust fan system for ventilating a structure having a roof and a roof opening, said system comprising:

a support assembly for fixedly positioning below the roof;

a motor having a driveshaft, said motor attached to said support assembly; and a fan assembly attached to said support assembly, said fan assembly including an impeller and an air deflector assembly, said impeller operatively coupled to said motor driveshaft and positioned within said air deflector assembly, said air deflector assembly including an intake portion and an exhaust portion, the air deflector assembly positioned relative to the roof such that air is drawn into the impeller through the intake portion, is exhausted from the impeller and passes through the exhaust portion and then through the roof opening;

wherein said air deflector assembly includes channel with a first intake end, a second intake end, a longitudinal exhaust slot and an inside surface, said first and second intake ends forming said intake portion and said longitudinal exhaust slot forming said exhaust portion, wherein rotation of said impeller by said motor draws air through said first and second intake ends of said air deflector, directs said airflow radially into said inside surface and said inside surface directs said airflow out through said longitudinal exhaust slot;

wherein said support assembly further includes a base member for said attachment of said motor and said fan assembly; and wherein said base member further includes a plurality of longitudinally spaced inlet ports positioned adjacent to and below said first and second intake ends thereby allowing increased airflow through said base member into said first and second intake ends.

29. A powered exhaust fan system according to claim 28, wherein said support assembly further includes a plurality of bracket members comprising a roof end and a base end, said plurality of bracket members longitudinally spaced along, and fixed to, said base member at said base end and said roof end for fixing to the roof.

* * * * *